US009388668B2

(12) United States Patent
McAnally

(10) Patent No.: US 9,388,668 B2
(45) Date of Patent: Jul. 12, 2016

(54) SUBTERRANEAN CHANNEL FOR TRANSPORTING A HYDROCARBON FOR PREVENTION OF HYDRATES AND PROVISION OF A RELIEF WELL

(71) Applicant: Robert Francis McAnally, Glasgow (GB)

(72) Inventor: Robert Francis McAnally, Glasgow (GB)

( * ) Notice: Subject to any disclaimer, the term of this patent is extended or adjusted under 35 U.S.C. 154(b) by 0 days.

(21) Appl. No.: 14/077,773

(22) Filed: Nov. 12, 2013

(65) Prior Publication Data

US 2014/0144647 A1 May 29, 2014

Related U.S. Application Data

(60) Provisional application No. 61/729,461, filed on Nov. 23, 2012.

(51) Int. Cl.
*E21B 36/00* (2006.01)
*E21B 43/01* (2006.01)

(52) U.S. Cl.
CPC ..... *E21B 36/005* (2013.01); *E21B 43/01* (2013.01)

(58) Field of Classification Search
CPC ..... E21B 7/043; E21B 36/005; E21B 43/01; E21B 43/017
USPC ..... 166/366, 368, 302; 137/15.07; 175/61, 175/62
See application file for complete search history.

(56) References Cited

U.S. PATENT DOCUMENTS

| | | | | | |
|---|---|---|---|---|---|
| 2,859,818 | A * | 11/1958 | Hall et al. | ..... | 166/269 |
| 3,199,588 | A * | 8/1965 | Holbert | ..... | 166/295 |
| 4,224,989 | A * | 9/1980 | Blount | ..... | 166/400 |
| 4,390,067 | A * | 6/1983 | Willman | ..... | 166/245 |
| 4,662,440 | A * | 5/1987 | Harmon et al. | ..... | 166/245 |
| 5,402,851 | A * | 4/1995 | Baiton | ..... | 166/369 |
| 6,000,471 | A * | 12/1999 | Langset | ..... | 166/268 |
| 6,119,776 | A * | 9/2000 | Graham et al. | ..... | 166/245 |
| 6,280,000 | B1 * | 8/2001 | Zupanick | ..... | 299/12 |
| 6,439,320 | B2 * | 8/2002 | Zupanick | ..... | 175/61 |
| 6,478,085 | B2 * | 11/2002 | Zupanick | ..... | 166/50 |
| 6,488,087 | B2 * | 12/2002 | Longbottom et al. | ..... | 166/271 |
| 6,561,288 | B2 * | 5/2003 | Zupanick | ..... | 175/69 |
| 6,591,903 | B2 * | 7/2003 | Ingle et al. | ..... | 166/50 |
| 6,932,168 | B2 * | 8/2005 | Morgan et al. | ..... | 175/62 |
| 6,976,533 | B2 * | 12/2005 | Zupanick | ..... | 166/50 |
| 7,025,154 | B2 * | 4/2006 | Zupanick | ..... | 175/69 |
| 7,100,687 | B2 * | 9/2006 | Pauley | ..... | 166/245 |
| 7,264,048 | B2 * | 9/2007 | Zupanick et al. | ..... | 166/245 |
| 7,426,963 | B2 * | 9/2008 | O'Neill | ..... | 166/365 |
| 7,451,814 | B2 * | 11/2008 | Graham et al. | ..... | 166/268 |
| 7,571,771 | B2 * | 8/2009 | Pratt et al. | ..... | 166/313 |
| 7,637,316 | B2 * | 12/2009 | Best et al. | ..... | 166/50 |
| 7,819,187 | B2 * | 10/2010 | Graham et al. | ..... | 166/245 |
| 7,918,283 | B2 * | 4/2011 | Balkanyi et al. | ..... | 166/344 |
| 2003/0056954 | A1 * | 3/2003 | Headworth | ..... | 166/302 |
| 2003/0209340 | A1 | 11/2003 | McClung, III | | |
| 2004/0079530 | A1 * | 4/2004 | Ribeiro et al. | ..... | 166/366 |
| 2013/0037272 | A1 * | 2/2013 | Dale et al. | ..... | 166/363 |

FOREIGN PATENT DOCUMENTS

| | | | |
|---|---|---|---|
| GB | 2382647 | A | 6/2003 |
| GB | 2435582 | A | 8/2007 |

* cited by examiner

*Primary Examiner* — Matthew R Buck
(74) *Attorney, Agent, or Firm* — Wright IP & International Law; Eric G. Wright

(57) ABSTRACT

There is herein described the prevention of hydrates and the provision of a Relief Well in an oil and gas Well. More particularly, there is described the prevention of hydrates in an oil and gas Well by utilizing the latent heat in the sub-soil and providing Subterranean Channels to facilitate the provision of Relief Well access.

13 Claims, 6 Drawing Sheets

SUBTERRANEAN CHANNEL FOR TRANSPORTING A HYDROCARBON FOR PREVENTION OF HYDRATES AND PROVISION OF A RELIEF WELL

FIELD OF THE INVENTION

The present invention relates to the prevention of Hydrates and the provision of a Relief Well in an oil and gas Well. More particularly, the present invention relates to the prevention of hydrates in an oil and gas Well by utilizing the latent heat in the sub-soil and providing Subterranean Channels to facilitate the provision of Relief Well access.

BACKGROUND OF THE INVENTION

The formation of hydrates in subsea oil and gas Wells is well understood and many methods have been attempted to alleviate the problems associated with these hydrates which have been described as like formation of ice crystals, which if severe enough can block the flow of hydrocarbons, shutting the production from a Well. The formation of hydrates are largely determined by the temperature and pressure of the hydrocarbons and occur when the temperature of the hydrocarbons from the subsea Well drops below a formation temperature, this formation temperature will also vary according to the chemical composition of the Well fluids. The Well fluids may also be affected by the formation of wax deposits which is also temperature dependent.

Production of hydrocarbons from offshore subsea oil and gas Wells is well established, and the prevention of the formation of hydrates and/or wax deposit is well known to be crucial to maintain the flow of hydrocarbons and the export to the market of the Well products. As subsea Wells become deeper and the distances from the Well to the processing facilities, either offshore or onshore, become longer the problem of hydrate formation and/or wax deposit is a limiting factor in the way in which an offshore oil or gas Field can be developed, and must be controlled. Typically, this is done by the injection of an inhibitor such as Monoethylene Glycol (MEG) or through insulation materials to coat the subsea Wellhead equipment and Pipelines and their connecting Jumpers (typically called Well Jumpers) and other Subsea Units or through electrical heating system on Pipelines. Subsea Units for the purposes of this discussion are any of the apparatus which is installed in a Subsea Production System (SPS) below the water line (i.e. subsea), which are used to transport hydrocarbons from the subsea Well(s) to an Export Pipeline. These mitigation measures are expensive solutions and lead to problems and costs with the injection and then extraction of the inhibitor from the hydrocarbons, or less than ideal coverage with insulation materials leading to 'cold spots'. Even very small areas left uncovered can lead to a breakdown in the insulation barrier leading to a hydrate formation or major wax deposit which can result in a Plug. The distances between the Subsea Units or Onshore Unit and the Wells (step-out distance) can be the limiting factor in whether a subsea oil or gas Field, or a portion of it, can be developed.

Other novel approaches have been patented in the attempt to control Hydrates and/or Wax deposits. Export Pipelines can be of a Pipe-in-Pipe design, or installed with various insulation materials or Heating System such as Trace Heating or Direct Electrical Heating.

Well jumpers present a particular set of problems because they connect the high pressure Wells to a subsea Manifold (or other processing equipment or Subsea Unit), and the Export Pipeline without the escape of hydrocarbons. A blockage caused by hydrates can lead to loss of production and lost revenue, and a fracture (or other loss of integrity) in the Well Jumper could result in serious pollution problems. Well Jumpers may be installed in trenches or covered by rock-dumping if water depth is shallow enough to be a danger to fishing activity. Well Jumpers may be Rigid or Flexible. Rigid Well Jumpers are difficult to fabricate and install subsea as they usually require to be fabricated when the subsea Tree (also known as a Subsea Christmas Tree or XT) and the subsea Manifold (or other processing equipment or Subsea Unit) are fully installed and subsea metrology is performed between two flanges (or other connection method) to determine the exact size of the Rigid Well Jumper. Fabrication of a Rigid Well Jumper with an insulation layer which has no 'cold spots' is obviously difficult to achieve. These Well Jumpers also limit the location of each Well relative to each other (the Field layout) as there are limits to the size of Well Jumpers for practical reasons such as installation vessel size and handling/deployment difficulties.

Template/Manifold solutions exist where the subsea Wells are drilled from a very heavy steel structure requiring that the Wells are drilled from that location and usually after the steel structure is lowered to the seabed by a heavy lift vessel, reducing but not eliminating the number of Well Jumpers, but placing restrictions on the sequence and timing of drilling activities and Subsea Unit installation. However, the Pipeline from such structures to Production Unit are affected by the same risks of hydrate formation or wax deposit.

Major accidents in oil and gas offshore industry have highlighted that these subsea Wells can be difficult to control in the event of a 'blow-out' (uncontrolled release of hydrocarbons), and the last and most difficult way to intervene and control the Well is to drill a 'Relief Well'. This is when a second Well is drilled and intersects with the first 'rogue' Well, and requires great accuracy and can take many months. A Relief Well can be drilled at the same time as the primary Well, or soon after, but the use of subterranean Channels in a 'Production Field' will greatly reduce the additional cost of such a Relief Well.

It is an object of at least one aspect of the present invention to obviate or mitigate at least one or more of the aforementioned problems.

It is a further object of at least one aspect of the present invention to provide an improved method for prevention of hydrates in an oil and gas Well by utilizing the latent heat in the sub-soil and providing subterranean Channels to facilitate the provision of Relief Well access.

SUMMARY OF THE INVENTION

According to a first aspect of the present invention there is provided a method of preventing the formation of hydrates and/or wax deposit in a Subsea Production System (SPS) comprising:

providing Subterranean Channels between adjacent Wells in an oil/gas Field;

locating the Subterranean Channels at a depth wherein the latent heat in the sub-soil is capable of preventing the formation of hydrates and/or wax;

wherein the Subterranean Channels are capable of being used to drill Relief Wells or provide access.

Generally speaking, the present invention resides in the provision of a method for the prevention of hydrates in an oil and gas Well by utilizing the latent heat in the sub-soil and providing Subterranean Channels to facilitate the drilling of Relief Wells or provide access (see FIG. 1).

This invention relates to the novel use of existing technology to control the formation of hydrates and/or wax deposit in a Subsea Production System (SPS), through the use of Subterranean Channels which are dug between adjacent Wells (or a single Well) of an oil/gas Field, and the Manifold (or other Subsea Unit) or possibly connecting to a Floating Production Storage Unit (FPSO) or Onshore Unit before connecting to the Export Pipeline. Other Subsea Units could be but are not limited to Pipeline End Terminations (known variously as PLEMs, FLETs), Inline Tee's (ILTs), Subsea Processing Unit, or any other device which is used to make connections and allow the Wells to be connected and thus export the hydrocarbons.

These Subterranean Channels can be dug by means of 'Tunnel Boring Machines (TBM)' such as are used in the excavation of tunnels for Transport (Road and Rail) and Service Utilities (such as sewers, and water supplies). It is thought that a small diameter tunnel can be produced by existing 'unmanned machines' which can be adapted to the subsea situation (marinised).

The Subterranean Channels can be dug using other methods such as Directional Drilling, or any other means to prepare the channel. The shape of the channel is not important, but circular is the most likely, being the simplest to construct.

The depth at which the subterranean channel is dug is crucial to the success of reducing hydrates (typically 100 m-500 m), and this will require to be calculated during the early design phase for each Field.

The Subterranean Channel must be at a depth where the subsoil temperature is high enough that hydrates will not form when the hydrocarbon is not flowing i.e. when the Well is shut-in and/or high enough that Wax will not deposit during production when the Well is flowing. Thus if the depth is correctly selected the temperature of the hydrocarbons will remain above the Hydrate formation temperature and Wax appearance temperature. The delivery temperature could also be a problem when the Well is flowing if this is too high. This invention describes how the surrounding seawater can be used to control the temperature of the flowing hydrocarbons by circulating the readily available seawater. Seawater around the seabed will be at a temperature of about 0° C. to 4° C., and circulation of this seawater (either by pump or natural convection) through pipework into the Subterranean Channels can be used to control the flowing temperature of the hydrocarbons thereby regulating the temperature and preventing over-heating.

If by natural convection this flow could be used to drive a Turbine. This Turbine would generate electricity, not through the produced hydrocarbons, but by a new invention, using the thermal differences of the seawater and the seabed sub-soil temperature differential and using the flowing seawater to drive the electricity generation. If the temperature differential is not enough to create convection, then Circulation Pumps may be used. Control of the flow and therefore the cooling effect would require some form of temperature regulator to adjust the flowrate of the water. Sea water could be used in one embodiment, but other fluids could also be used, if the specific design or corrosion issues demand.

One embodiment includes a Pig-able Ring as a 'Ring Main' where all the Subterranean Channels are connected together to form a continuous circuit (see FIG. 2). This is of benefit in the process of Pigging. Pigging is commonly performed on subsea Pipelines to maintain the cleanliness of the Pipeline from Wax and Scale deposits in addition to Hydrates. A ring circuit of Subterranean Channels connecting all of the Wells of the Field would allow for the routine maintenance requirement of Pigging.

Subterranean Channels could be dug from a 'TBM Launch station', or other method. It is not intended to specify every tunnelling/drilling method available but to demonstrate that at least one method is feasible. This TBM Launch station could be from the seabed in an open top concrete box or at the bottom of a deep concrete lined shaft (techniques currently employed on land based construction projects). TBM's would drill and at the same time line the Subterranean Channels with an impervious liner such as concrete (or other material), from this location to the pre-determined design depth and then in an almost level attitude (a slight incline will assist in drainage) until the adjacent Well is reached. Intersection with any Well and the Subterranean Channel will depend on the preferred subsea architecture and could be achieved using the TBM or Directional Drilling, and will be affected by design considerations such as whether Well Jumpers are used, and safety considerations regarding the drilling of the Well.

Branches need to be constructed to connect the Subterranean Channel to the Well. These would be constructed by inserting a special 'Y-section' at each Branch location (see FIG. 6). The procedure envisaged at each 'Y' would be: dig with TBM until break through occurs and exposes the previous Channel/Pipe section. Steer the TBM to create a 'Y' intersection and continue digging until the Well is reached (breakthrough to the Well may or may not occur at this point). A special 'Y' section would be inserted into the Channel in place of the Liner, which would have a slot contoured in the inner profile (see drawing). The Tubing connections would be made at this point before continuing the Channel construction. TBM Launch Stations may be abandoned as the construction continues and they are no longer required.

The desired diameter of Pipe would be run into the open Channel from the TBM Launch Station in sections, or as a coil if the design diameter would allow. A 'V-Block' construction could be installed with the Channel Liner to assist the alignment of each section with the previous one installed (the Pipe will self-align at the bottom of the 'V'). The pipe ends would be prepared for welding with a required chamfer and a 'Capture Funnel' on the mating end would ensure any mis-alignment could be accommodated, while regulating the welding gap by means of a step on the outer diameter of the pipe (see FIG. 5). Stabbing-in the Pipe to the previous section and then Automated Internal Orbital Welding and NDT would be performed to ensure a continuous and pressure tight Pipeline.

Welded 'Y's would be required at the branch-off to each subsea Well. The next Pipe section which is intended to enter the 'Y-Branch' will have a Guidance Bar fitted to the end. This Guidance Bar is sized to give clearance with the Channel Liner, but will enter the slot only when it is correctly aligned. Pushing the pipe/bar into the contoured Slot will cause the Pipe to follow a path and divert down the Y-branch and so to the Well.

Connecting from the Well end of the Branch to the Ring Main could use the same method. A contoured Slot would be formed in the 20" Conductor Pipe at a distance below the 30" Conductor Pipe creating a 'Y' exit from the 20" Conductor Pipe. Tubing of a weldable grade, inserted through the Wellhead with a Guidance Bar attached would drop vertically until the contoured Slot was engaged. Dropping the Tubing further would divert the Tubing off into the 'Y-Branch' and with further insertion into the pre-drilled channel the Tubing would arrive at the Ring Main. Tubing would be cut to length and prepared for welding at the Ring Main end and welding performed at the 'Y-Branch'. This will require the use of a special machine tools and angled orbital Welding apparatus.

If the Subterranean Channel is to be used to create 'Relief Well access' then communication between the Subterranean Channel and the Well will be required. It is considered that Well Annulus and Production Tubing access could be achieved through Coil Tubing or some pre-installed connection between the Well and the Subterranean Channel (this could involve the provision of a second Pipe for Annulus access). The design of any such connection would be subject to extensive design work and safety considerations. The drilling of Relief Wells already exist and are practiced by the Oil & Gas industry. Whether these connections are made at the outset or left until they are required is up to the aforementioned design and safety considerations, however Subterranean Channels will provide the opportunity to have an access point to regain Well control in an emergency.

There are two intrinsically different ways of making the connections from the Wellhead/XT to the Subterranean Channel. One would see a traditional design whereby the Subsea Tree is connected through a Well Jumper (or other connection external to the pressure containing Wellhead) to a Branch leading to the Subterranean Channel (see FIG. 3). This method is not thought to be optimal as the Subsea Tree pipework and the Well Jumper would give risk of Hydrate formation, and may not give ready access to the Well in the event of a Blow-out if there were loss of control of the Subsea Tree or physical damage preventing the operation of the Subsea Tree Valves.

A second embodiment of the invention would see the Wellhead to Subterranean Channel connected in a subterranean manner (see FIG. 4). The flow of hydrocarbons would not exit the Subsea Tree as in the traditional design, but would exit through the Wellhead Housing or Conductor Casing by means of a Y-shaped branch after passing through a Choke Valve to allow the necessary balancing of the different pressures of the Wells in the Field. This would enable the produced hydrocarbons to remain out of cooling effect of the seawater for the maximum prevention of Hydrates.

Connection from the subsea Well to the Subterranean Channel without the use of a Well Jumper would give certain cost advantages. Such as lower capex cost of the Subsea Tree as the Connection system and Well Jumpers would be removed. Reduced installation activities, with fewer Rigid Well Jumpers subsea metrology and Rigid Well Jumper fabrication would be reduced. Improved safety with fewer exposed connections and Well Jumpers on the seabed connecting Subsea Units. Simpler XT's would lead to improved reliability and consequently higher availability.

With the use of Subterranean Channels as described, the relative location of the Wells (the step-out distance) of an oil or gas Field, can now be further apart and are not restricted by Well Jumper size. Drilling distance from the Subsea Wellhead to the 'payzone' of the Well can be reduced, as the Wells can be drilled directly over or close to the payzone. Subterranean Channels are currently possible up to 1 Kilometer with existing technology and with the use of intermediate TBM Launch Stations this distance can be extended further, greatly increasing flexibility of the Field Layout design and reducing the Well drilling distances.

This invention of connecting Wells through Subterranean Channels provides a means whereby a Well of which control has been lost and may have caused the release of hydrocarbons in an uncontrolled manner, could be brought under control from an adjacent Well. Access to the rogue Well could be achieved through the Subterranean Channels, and intervention could be achieved quickly and without the time delay and uncertainty of drilling a 'Relief Well'. The specific details of how this would be done is not described, but would be performed by skilled and knowledgeable experts who would prepare processes and procedures, which are not described in this invention. However, the use of Subterranean Channels provides this opportunity, and would not introduce a significant extra cost that would be incurred if the Relief Well or Wells were drilled together with the primary Wells.

Subterranean Channels provide the ability to run monitoring equipment from an adjacent Well which would give added safety benefits in the event of a Blow-out. If control of a Well was lost through the elimination of control to the rogue Well, either hydraulically, electrically or by physical damage, monitoring from an adjacent Well would provide vital information on the rogue Well's condition (primarily Annulus and Tubing pressures, integrity of and open or closed position of the Subsurface Surface-Controlled Safety valve (SSCSV) barrier. This functionality would require to be designed into the subsea architecture, but Subterranean Channels provide the opportunity to build in this safety enhancement.

The present invention uses the latent heat in the sub-soil in the up to 500 meter depth below the seabed where subterranean connections created between the subsea Wells and other Subsea Units or to the shore, will prevent the hydrocarbons from falling below the hydrate formation temperature or/and Wax Appearance Temperature (WAT).

This invention is a novel use of existing technologies which when adapted to the subsea situation to create subterranean connections between subsea Wells and the various Subsea Units or Onshore Unit, it is claimed will provide a substantial reduction of the problems presented by hydrate formation or/and wax deposit, and in doing so will give an added safety benefit by creating a 'Relief Well' during the initial construction of a 'Subsea Production Facility', in addition to potential increases in the access to remote or marginal reserves, and construction and operational cost savings.

Subterranean Channels as described in this invention will provide the facility to access a Well from an adjacent Well giving the possibility to 'kill' the Well and bring it under control.

During 'The Macondo' accident in the Gulf of Mexico in April 2010, the well was brought under control in 8 hours, but took 3 months to create the necessary access through the Relief Well after it had released an estimated 4.9 million barrels of crude oil. The use of Subterranean Channels between Wells provides the possibility to create this Relief Well access as part of the permanent Subsea Installation without drilling a long reach Well.

The perceived benefits of the Subterranean Channels are:

1. Less risk of shut-in Wells due to hydrate or wax plug and associated cost of intervention.
2. Relief Well access comes with little added cost, installed during the construction phase and could eliminate the extreme costs and environmental impacts witnessed during the past major accidents.
3. Opportunity to increase the step-out distance and 'unlock' previously unreachable reserves.
4. Pipelines and Well Jumpers can be better protected, and any damage to the Pipeline resulting in a loss of hydrocarbons would be contained within the Subterranean Channel, and not lost to the sea.
5. Less hydrate inhibitor injection/less chemical recovery—reducing FPSO capital and OPEX costs, and the safety risks of hydrate inhibitor management.
6. Less lost production during shut-down while pigging of Pipelines.
7. Less Insulation—reduced cost and less possibility of a cold-spot.
8. Simpler XT if no Rigid Well Jumper connections are used, leading to CAPEX cost savings and smaller/fewer Subsea Protection Structures (if required) and higher reliability.

9. Reduced Well drilling distance. Leading to reduced cost to drill a Well, and to more available Rig capacity (Wells can be less horizontal, if desired), and potentially fewer FPSO's in very large Fields.
10. Less time to do metrology and install Rigid Well Jumper's.
11. Less seabed preparation.
12. Cost of installing pipe in Subterranean Channels is expected to be less than the cost than laying a Pipeline on the seabed.
13. Flexible schedule—Subterranean Channel construction can start immediately that the field layout is confirmed, and fewer issues of combined vessel operations in the Field (COMOP's).
14. No need to install a heavy template structure which requires the Wells to be drilled from that location.
15. Potentially less dependent on weather as Pipeline installation work is from a stationary boat.
16. The possibility of a direct connection subsea-to-beach, with removal of FPSO or Platform.
17. Reduced need of protection from fishing activities.
18. Additional safety benefit of monitoring a Well from an adjacent Well.

There are new challenges to design and install the Subterranean Channels but the above benefits, are thought to outway the cost associated with adapting the necessary existing technology to the subsea environment.

This invention also applies to the subterranean burial of an Export Pipeline in a Subterranean Channel from the SPS to the beach or another subsea field, if found to be feasible and cost effective. This invention also applies to the use of Subterranean Channels where hydrates/Wax deposits are not a problem, but cost and safety benefits (or other benefits) can be made by the use of connecting Wells and Subsea Units/Pipelines and Onshore Units, through Subterranean Channels.

According to a second aspect of the present invention there is provided apparatus preventing the formation of hydrates and/or wax deposit in a Subsea Production System (SPS), said apparatus comprising:

Subterranean Channels located between adjacent Wells in an oil/gas Field;

locating the Subterranean Channels at a depth wherein the latent heat in the sub-soil is capable of preventing the formation of hydrates and/or wax;

wherein the subterranean channels are capable of being used to drill Relief Wells or provide access.

BRIEF DESCRIPTION OF THE DRAWINGS

Embodiments of the present invention will now be described, by way of example only, with reference to the accompanying drawings in which.

BRIEF DESCRIPTION

Generally speaking, the present invention resides in the provision of prevention of hydrates in an oil and gas Well by utilizing the latent heat in the sub-soil and providing Subterranean Channels to facilitate the drilling of Relief Wells or provide access.

Figure 1:
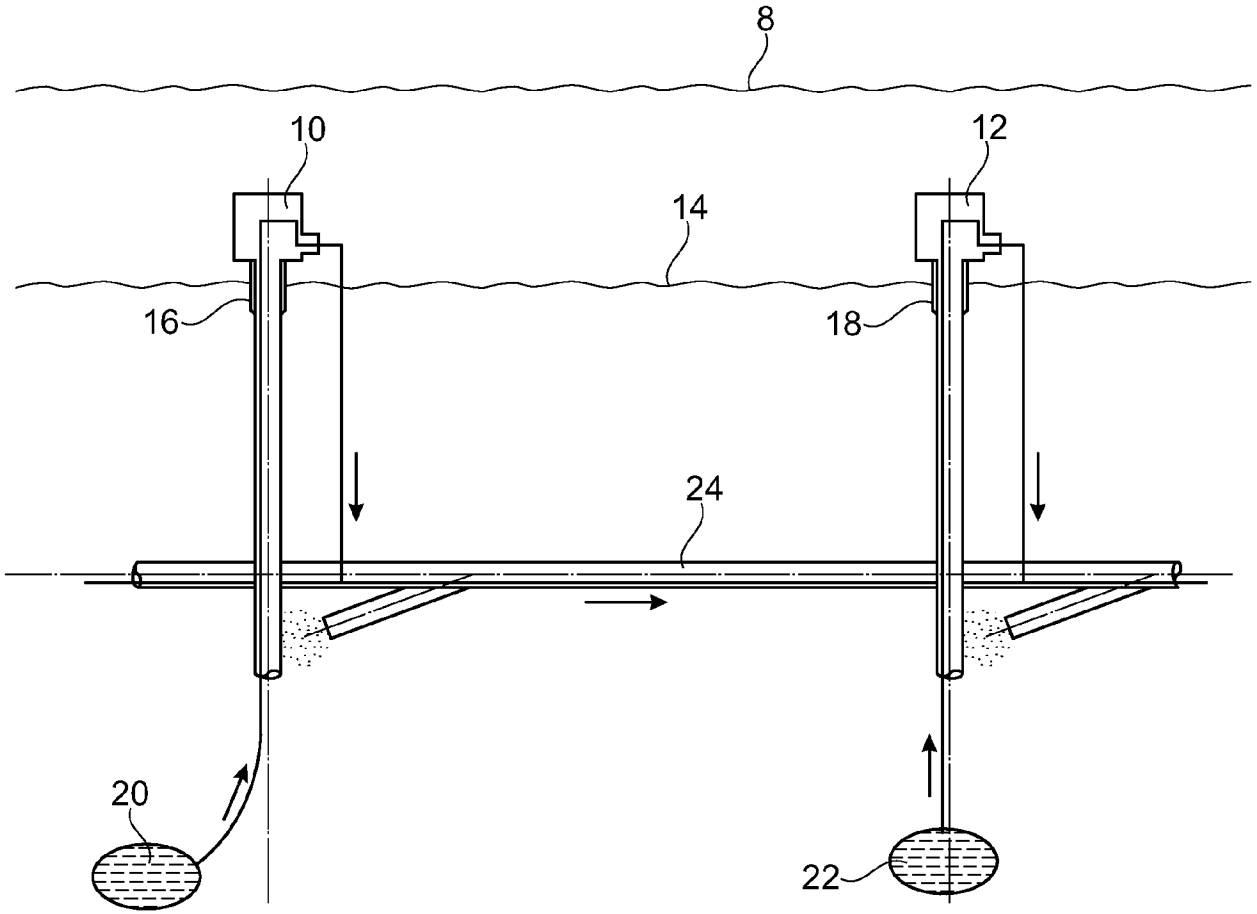
FIG. 1 is view of a Subterranean Connection of Subsea Wells for Prevention of Hydrates according to an embodiment of the present invention.

FIG. 1 shows two subsea XT apparatus 10, 12 located above the seabed 14 and below the sea level 8. Situated underneath the two subsea XT apparatus 10, 12 there are wellheads 16, 18. The drilling operation is shown to access payzones 20, 22 where oil/gas is located. As shown in FIG. 1 there is a subterranean channel 24 which is excavated at a suitable depth of say 100 m-500 m where the latent heat is capable of preventing the pipeline from 'freezing' up due to hydrates. The subterranean channel 24 allows the connection of Wells to occur. By utilizing the subterranean channel 24 allows Relief Wells to be drilled or provide such access.

Figure 2:
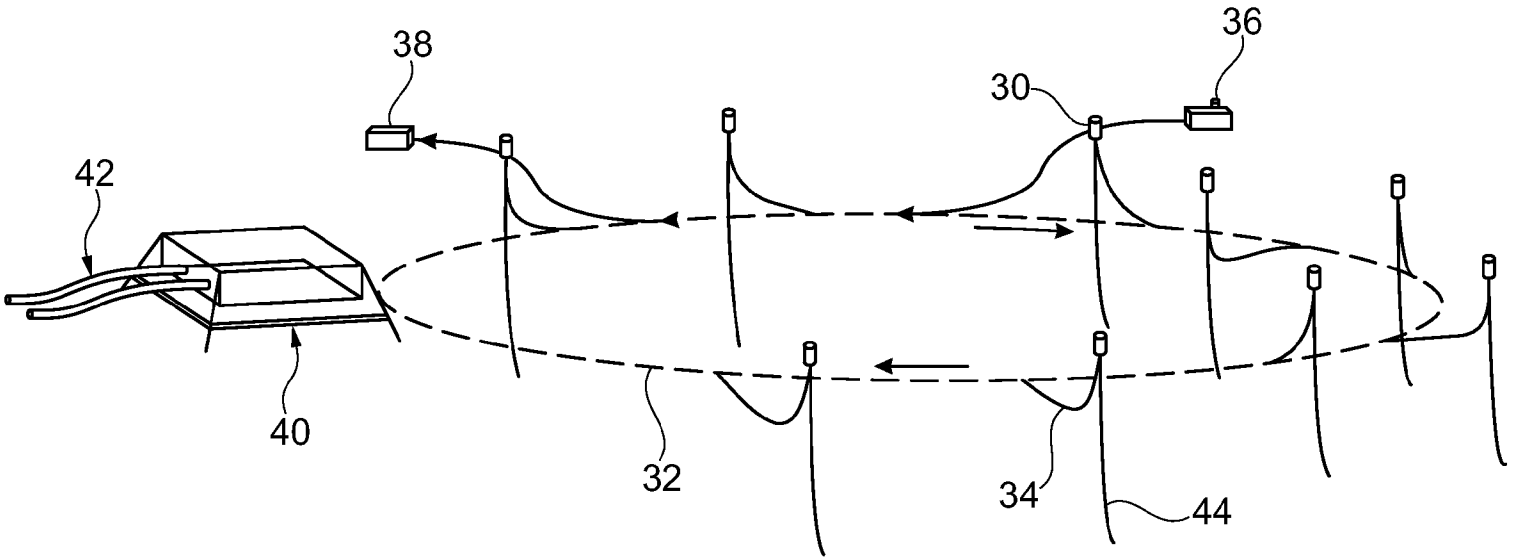
FIG. 2 is a view of a Ring Main design to create a Pig-able Loop according to an embodiment of the present invention.

FIG. 2 shows a series of subsea Wellheads 30 which are interconnected with a Pig-able ring 32. There is also shown a series of branches 34, a TBM Launch Station 36, a TBM Receiving Station 38, a Manifold/Pig launcher 40 and an Export Pipeline 42. Downhole completion 44 is also shown.

Figure 3:
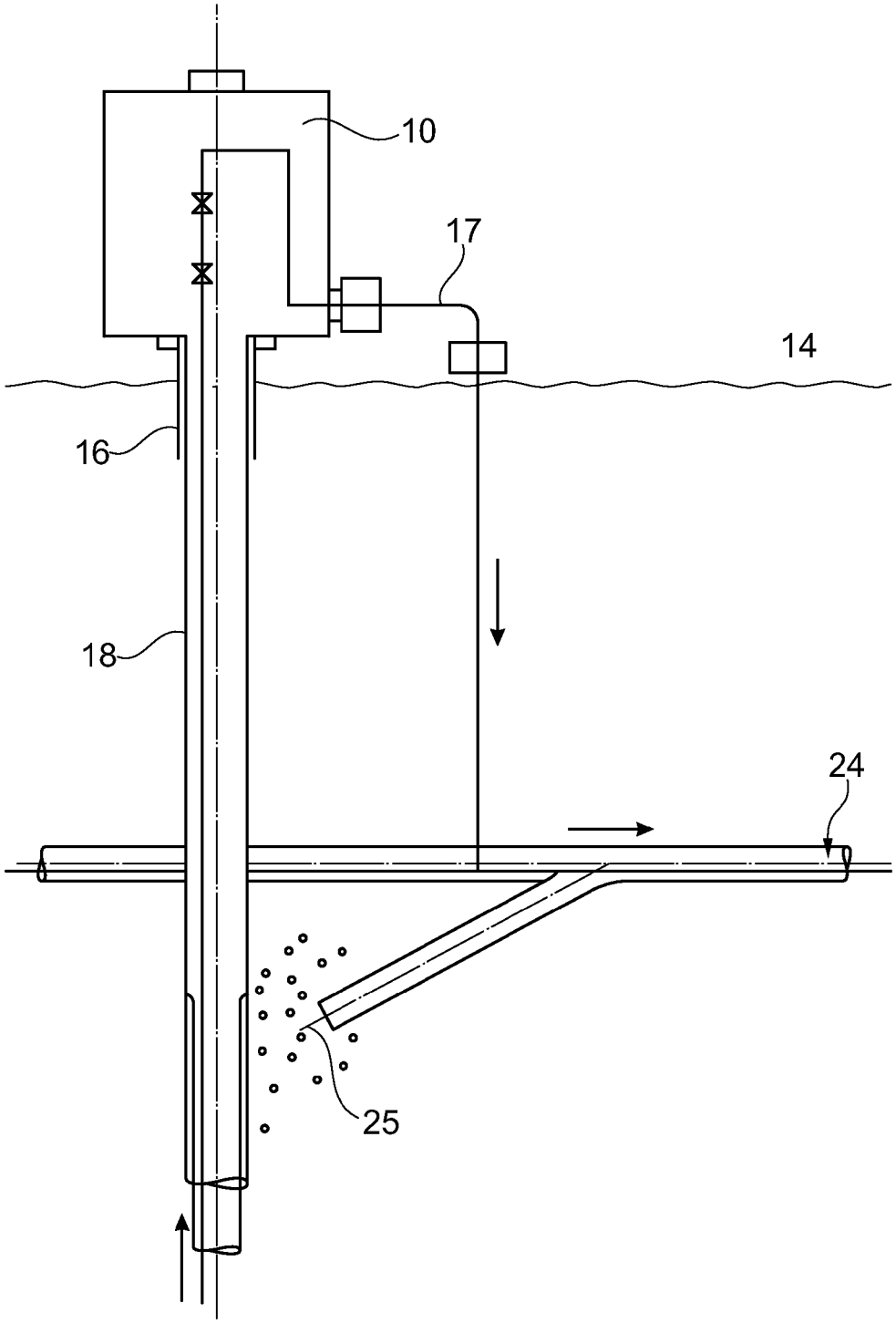
FIG. 3 is a view of a Connection from an XT to the Subterranean Channel with Well Jumper according to an embodiment of the present invention.

FIG. 3 is an expanded view of part of the system shown in FIG. 1 which shows the subsea XT 10, Wellhead 16 and Casing 18. There is also a Jumper 17 located just above the seabed 14. The Subterranean Channel 24 is also connected to a 'Y-branch' 25 which is prepared but not drilled through to the Well annulus.

Figure 4:
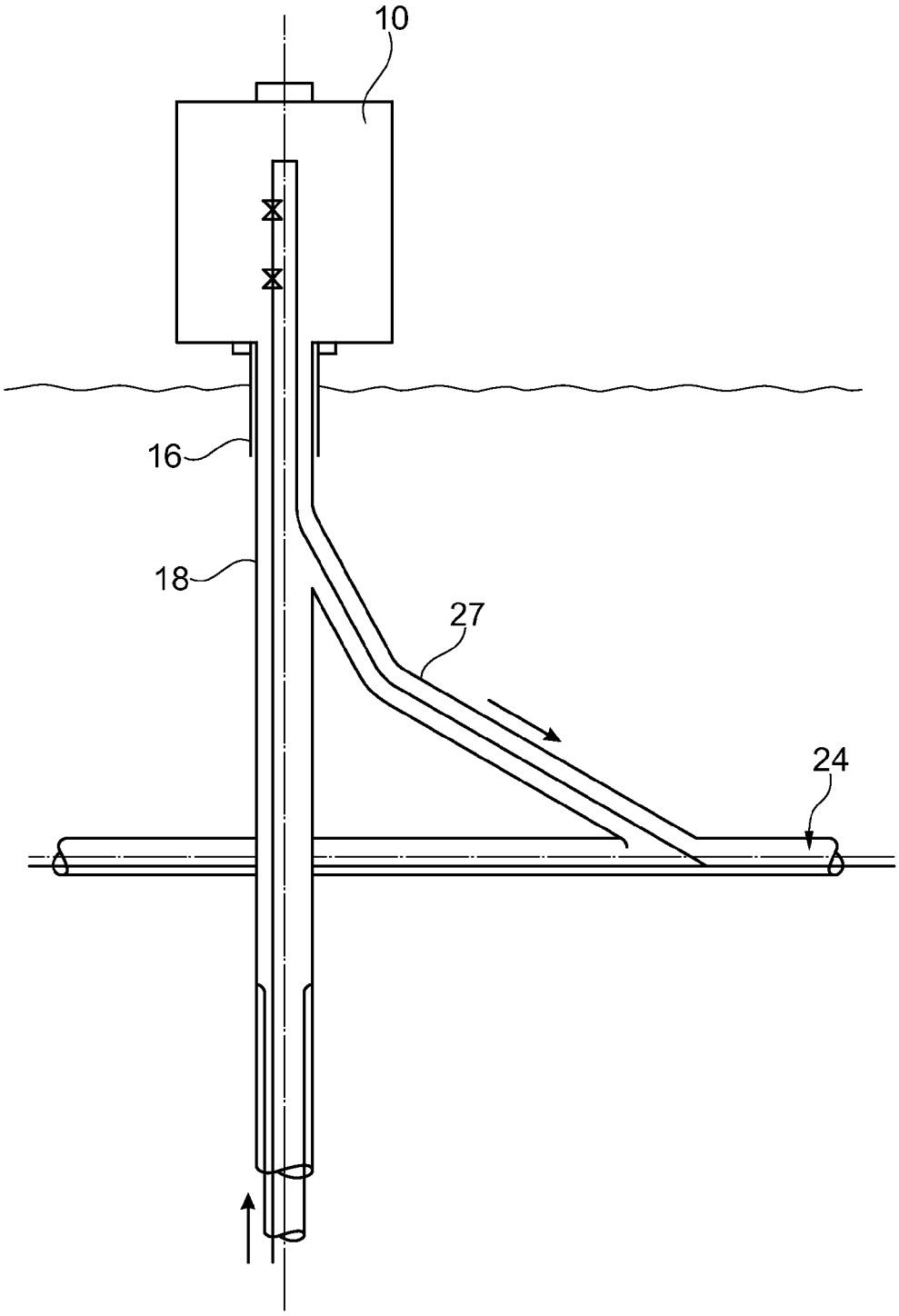
FIG. 4 is a view of a Connection from the XT to the Subterranean Channel without Well Jumper, Relief Well added according to an embodiment of the present invention.

FIG. 4 shows the situation where a Relief Well 27 has been drilled connecting the Wellhead 16 and the Subterranean Channel 24.

Figure 5:
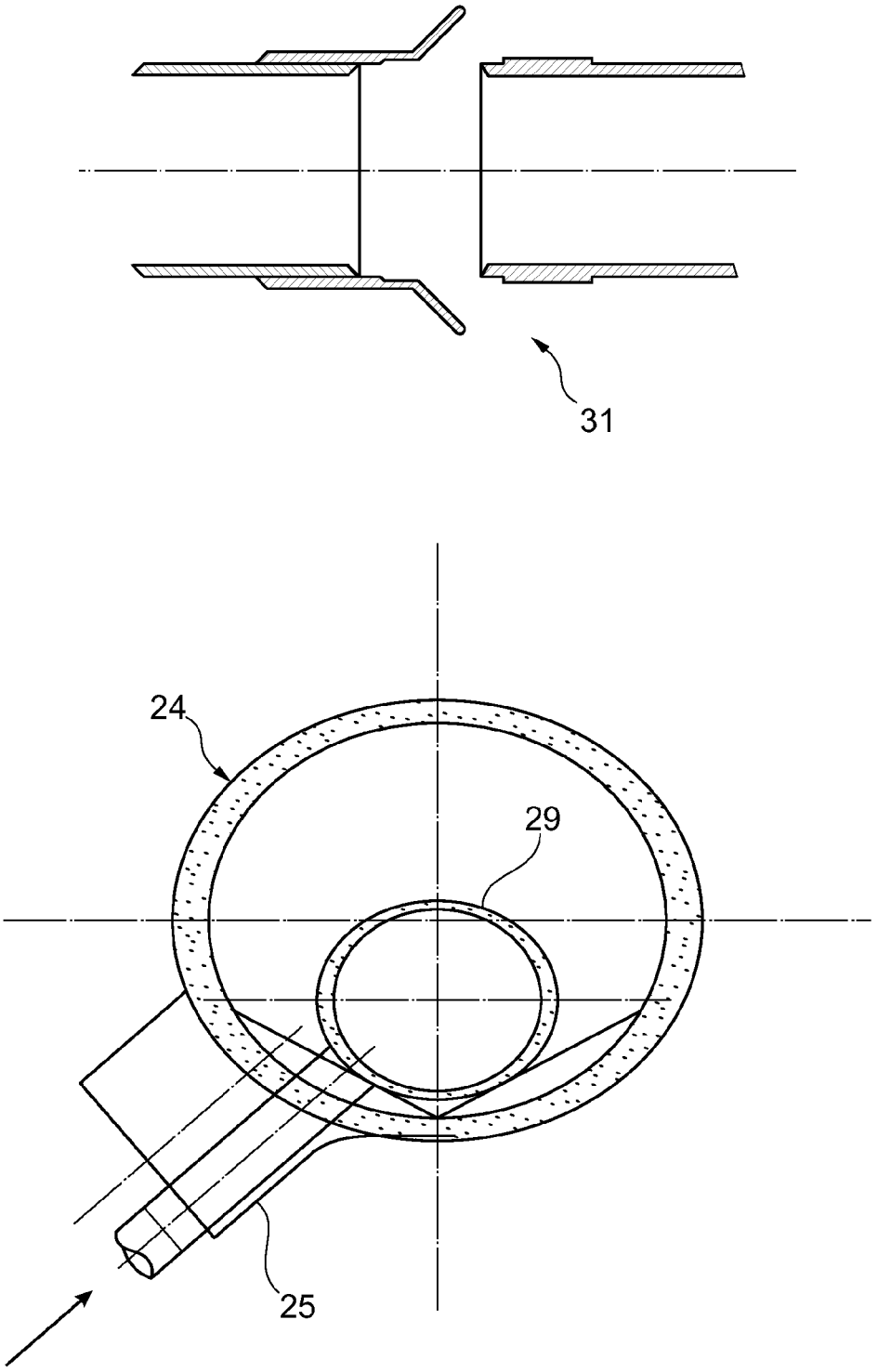
FIG. 5 is a view of a Cross-section through Subterranean Channel according to an embodiment of the present invention.

FIG. 5 shows a cross-section through the Subterranean Channel 24 containing the Export Pipeline 29 and the Y-branch 25. Also shown is the pipe alignment mechanism 31 used during the construction of the Pipeline 29.

Figure 6:
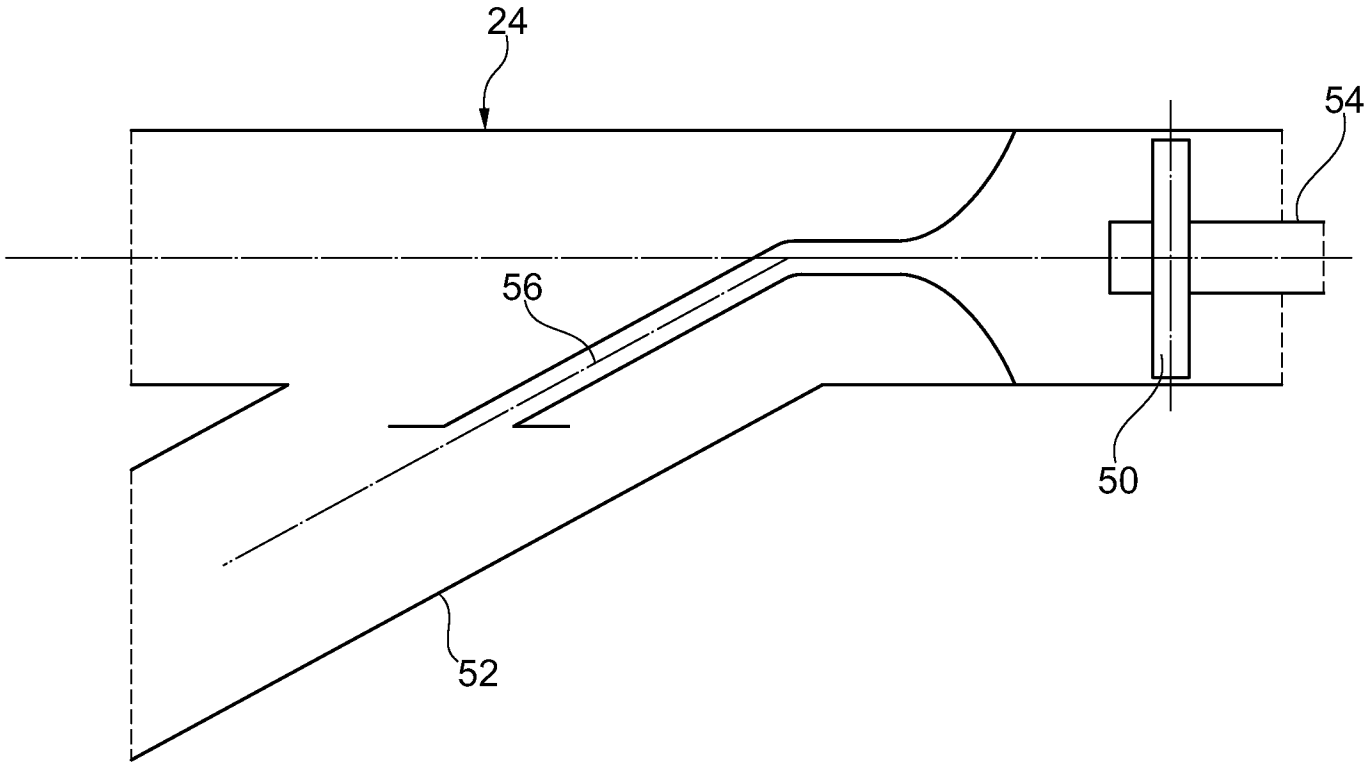
FIG. 6 is a view of the Y-branch construction and Guidance Bar mechanism.

FIG. 6 is a view of the Y-branch construction 52 and Guidance Bar mechanism 50 with Guidance Slot 56. The Subterranean Channel 24 is also shown along with production tubing 54.

Whilst specific embodiments of the present invention have been described above, it will be appreciated that departures from the described embodiments may still fall within the scope of the present invention. For example, any suitable type of and shape of Subterranean Channel may be used in the present invention. Channels may be dug by TBM's, Directional Drilling or other means.

The invention claimed is:

1. A method of preventing the formation of hydrates and/or wax deposits in a subsea production system (SPS) for use to transport hydrocarbons from a subsea well or wells to a subsea unit, a floating production storage unit (FPSO) or an onshore unit, comprising:

providing one or more subterranean channels between an adjacent well or wells in an oil/gas field and said subsea unit, FSPO or onshore unit;

locating the one or more subterranean channels at a depth wherein the latent heat in the sub-soil is capable of preventing the formation of hydrates and/or wax;

wherein the one or more subterranean channels are capable of being used to drill relief wells;

wherein surrounding seawater is used to control the temperature of flowing hydrocarbons in the SPS by circulating seawater through the one or more subterranean channels, and wherein the seawater around the seabed is at a temperature of about 0° C. to 4 C., and circulation of this seawater either by pumping or natural convection through pipework into the one or more subterranean channels is used to control the flowing temperature of the hydrocarbons in the SIPS and thereby prevent the formation of hydrates and/or wax deposits.

2. A method of preventing the formation of hydrates and/or wax deposits in a subsea production system (SPS) according to claim 1, wherein each subterranean channel is located about 100 m-500 m below the seabed and wherein the subsoil temperature is greater than a temperature that hydrates will form when the hydrocarbons in the SPS are not flowing and/or greater than a temperature that wax will deposit during production when the well is flowing.

3. A method of preventing the formation of hydrates and/or wax deposits in a subsea production system (SPS) according to claim 1, wherein each subterranean channel is dug by tunnel boring machines (TBM).

4. A method of preventing the formation of hydrates and/or wax deposits in a subsea production system (SPS) according to claim 1, wherein each subterranean channel is formed from a small diameter tunnel which can be produced by existing unmanned machines which can be adapted to the subsea situation.

5. A method of preventing the formation of hydrates and/or wax deposits in a subsea production system (SPS) according to claim 1, wherein the shape of each subterranean channel is tubular.

6. A method of preventing the formation of hydrates and/or wax deposits in a subsea production system (SPS) according to claim 1, wherein the subsea production system (SPS) comprises a pig-able ring as a ring main where a plurality of subterranean channels are connected together to form a continuous circuit.

7. A method of preventing the formation of hydrates and/or wax deposits in subsea production system (SPS) according to claim 1, wherein a branch is used to connect the one or more subterranean channels to an adjacent well and the branch can be constructed using a Y-section.

8. A method of preventing the formation of hydrates and/or wax deposits in a subsea production system (SPS) according to claim 1, wherein there is communication between the one or more subterranean channels and an adjacent well wherein well annulus and production tubing access is achieved through coil tubing or some pre-installed connection between the well and the one or more subterranean channels.

9. A method of preventing the formation of hydrates and/or wax deposits in a subsea production system (SPS) according to claim 1, wherein a wellhead and the one or more Subterranean Channels are connected in a subterranean manner wherein the flow of hydrocarbons would not exit a subsea tree but exits through a wellhead housing or conductor casing by means of a Y-shaped branch (or other shaped connection) after passing through a choke valve or other device to allow the necessary balancing of the different pressures of the wells in the field.

10. A method of preventing the formation of hydrates and/or wax deposits in a subsea production system (SPS) according to claim 1, wherein each subterranean channel provides the ability to run monitoring equipment from an adjacent well which provides added safety benefits.

11. A method of preventing the formation of hydrates and/or wax deposits in a subsea production system (SPS) according to claim 1, wherein the one or more subterranean channels provide communication between the subsea wells and said subsea unit, floating production storage unit (FPSO) or onshore unit, and such communications provides a safety benefit by creating a relief well or provide access during the initial construction of a subsea production facility and/or an access to a remote or marginal reserves.

12. A method of preventing the formation of hydrates and/or wax deposits in a subsea production system (SPS) according to claim 1, wherein a turbine or other power generation device can be used to generate electricity from the thermal differences of the seawater and the seabed sub-soil temperature differential and flowing seawater.

13. Apparatus for preventing the formation of hydrates and/or wax deposits in a subsea production system (SPS) for use to transport hydrocarbons from a subsea well or wells to a subsea unit, a floating production storage unit (FPSO) or an onshore unit, said apparatus comprising:

one or more subterranean channels located between an adjacent well or wells in an oil/gas field and said subsea unit, FSPO or onshore unit;

the one or more subterranean channels are located at a depth wherein the latent heat in the sub-soil is capable of preventing the formation of hydrates and/or wax of flowing hydrocarbons in the SPS;

wherein the one or more subterranean channels are capable of being used to drill relief wells;

wherein seawater around the seabed is at a temperature of about 0° C. to 4° C., and the seawater is circulated through the one or more subterranean channels by pumping or natural convection so as to control the temperature of flowing hydrocarbons in the SPS, in use, and thereby prevent the formation of hydrates and/or wax deposits.

* * * * *